US005663737A

United States Patent [19]

Kakizawa

[11] Patent Number: 5,663,737

[45] Date of Patent: Sep. 2, 1997

[54] WINDOW GLASS ANTENNA FOR AUTOMOBILE TELEPHONE

[75] Inventor: Hitoshi Kakizawa, Chiba, Japan

[73] Assignee: Nippon Sheet Glass Co., Ltd., Japan

[21] Appl. No.: 621,771

[22] Filed: Mar. 22, 1996

Related U.S. Application Data

[63] Continuation of Ser. No. 283,772, Aug. 1, 1994, abandoned.

[30] Foreign Application Priority Data

Jul. 30, 1993 [JP] Japan ..... 5-189970

[51] Int. Cl.[6] ..... H01Q 1/32

[52] U.S. Cl. ..... 343/713; 343/704

[58] Field of Search ..... 343/711, 712, 343/713, 704; H01Q 1/32

[56] References Cited

U.S. PATENT DOCUMENTS

| | | | |
|---|---|---|---|
| 4,527,164 | 7/1985 | Cestoro et al. | 343/713 |
| 4,602,260 | 7/1986 | Lindenmeir et al. | 343/713 |
| 4,727,377 | 2/1988 | Yotsuga et al. | 343/711 X |
| 4,746,925 | 5/1988 | Toriyama | 343/713 |
| 4,914,447 | 4/1990 | Ishii et al. | 343/713 |
| 5,220,336 | 6/1993 | Hirotsu et al. | 343/713 |
| 5,255,002 | 10/1993 | Day | 343/713 |
| 5,264,858 | 11/1993 | Shiina | 343/713 |
| 5,293,174 | 3/1994 | Kropielnicki et al. | 343/713 |
| 5,353,039 | 10/1994 | Tsukada et al. | 343/713 |
| 5,365,242 | 11/1994 | Shiina | 343/713 |
| 5,418,543 | 5/1995 | Bolton | 343/713 |

FOREIGN PATENT DOCUMENTS

| | | | |
|---|---|---|---|
| 3824417 | 1/1990 | Germany | H01Q 1/32 |
| 63-90306 | 6/1988 | Japan . | |
| 63-90603 | 6/1988 | Japan | H01Q 1/32 |
| 4132401 | 5/1992 | Japan | H01Q 1/32 |
| 5-82113 | 11/1993 | Japan . | |

*Primary Examiner*—Donald T. Hajec
*Assistant Examiner*—Tan Ho
*Attorney, Agent, or Firm*—Merchant, Gould, Smith, Edell, Welter & Schmidt

[57] ABSTRACT

A window glass antenna for automobile telephone has a hot antenna wire mounted on a window glass panel substantially horizontally in electromagnetically coupled relation to either an upper or lower horizontal member of a metallic window frame, a ground antenna wire mounted on the window glass panel in a position displaced inwardly from the hot antenna wire toward the geometric center of the window glass panel, the ground antenna wire having an end disposed near an end or a center of the hot antenna wire.

10 Claims, 5 Drawing Sheets

WINDOW GLASS ANTENNA FOR AUTOMOBILE TELEPHONE

This is a file wrapper continuation of application Ser. No. 08/283,772, filed Aug. 1, 1994, now abandoned.

BACKGROUND OF THE INVENTION

1. Field of the Invention

The present invention relates to a window glass antenna for automobile telephones and more particularly to a window glass antenna for transmitting and receiving vertically polarized radio waves for automobile telephones.

2. Description of the Prior Art

One conventional window glass antenna disclosed in Japanese laid-open utility model publication No. 5-82113 is illustrated in FIG. 7 of the accompanying drawings. As shown in FIG. 7, the window glass antenna, generally designated by the reference numeral 100, has a radiating pattern 101 extending vertically on a window glass panel, and a hollow grounding pattern 102 disposed on the window glass panel below the radiating pattern 101. The radiating pattern 101 has a lower end portion 101*a* connected to an end of the core of a feeding coaxial cable (not shown). The grounding pattern 102 has an upper central portion 102*a* connected to the braided shield of the feeding coaxial cable. The other end of the feeding coaxial cable is connected to an antenna terminal of an automobile telephone set or a radio receiver on an automobile.

FIG. 8 of the accompanying drawings shows the pattern of another known window glass antenna for automobile telephone as disclosed in Japanese laid-open patent publication No. 63-90306. The window glass antenna, generally designated by the reference numeral 110 in FIG. 8, comprises vertically spaced horizontal wires 111, 112, 113 disposed on a window glass panel, a joint wire 114 disposed on the window glass panel and interconnecting ends of the horizontal wires 111, 112, 113, a first feeding point 115 on the horizontal wire 113, an auxiliary antenna wire 117 extending vertically on the window glass panel between the horizontal wires 111, 112 and open opposite ends, and a second feeding point 116 on the lower open end of the auxiliary antenna wire 117 which is positioned closely to the first feeding point 115.

Since vertically polarized radio waves are mainly used for automobile telephone, the radiating pattern 101 (see FIG. 7), the joint wire 114 (see FIG. 8), and the auxiliary antenna wire 117 (see FIG. 8) are generally oriented vertically on the window glass panels. It is necessary to position these antenna elements as far from metallic automobile body components as possible to avoid an undesirable reduction in the reception sensitivity.

If these antenna elements are to be disposed above or below defrosting wires on the window glass panel, then it is necessary to provide a space which is vertically as long as the antenna elements above or below defrosting wires on the window glass panel, so that the antenna elements can be positioned in that space. Therefore, the defrosting wires may not have sufficient vertical dimension, and any defrosting area on the window glass panel may not be sufficiently large.

The window glass antenna 100 shown in FIG. 7 is required to have a certain pattern width because a frequency band handled thereby is determined by the widths of the patterns 101, 102. However, the required pattern width of the window glass antenna 100 may interfere with the vision of the driver of the automobile.

SUMMARY OF THE INVENTION

It is therefore an object of the present invention to provide a window glass antenna for an automobile telephone which has antenna elements that can be positioned closely to metallic components of an automobile body and are in the form of less conspicuous members.

According to the present invention, there is provided a window glass antenna for an automobile telephone, comprising a window glass panel supported by a metallic window frame of an automobile body, the metallic window frame having upper and lower horizontal members, a hot antenna wire mounted on the window glass panel substantially horizontally in electromagnetically coupled relation to either the upper or lower horizontal member of the metallic window frame, and a ground antenna wire mounted on the window glass panel in a position displaced inwardly from the hot antenna wire toward the geometric center of the window glass panel, the ground antenna wire having an end disposed near an end or a center of the hot antenna wire.

The ground antenna wire may extend substantially horizontally parallel to the hot ground antenna wire, and a second ground antenna wire may be composed of a vertical segment connected to the end of the first-mentioned ground antenna wire and a horizontal segment connected to the vertical segment.

The ground antenna wire may extend substantially vertically, and a second ground antenna wire may be connected to the end of the first-mentioned ground antenna wire and angularly spaced 45° counterclockwise from the first-mentioned ground antenna wire about the end thereof. The window glass antenna may further include a third ground antenna wire connected to the end of the first-mentioned ground antenna wire and angularly spaced 45° clockwise from the first-mentioned ground antenna wire about the end thereof.

According to the present invention, there is also provided a window glass antenna for an automobile telephone, comprising a window glass panel supported by a metallic window frame of an automobile body, the metallic window frame having upper and lower horizontal members, a plurality of parallel hot antenna wires mounted on the window glass panel substantially horizontally in electromagnetically coupled relation to either the upper or lower horizontal member of the metallic window frame, the hot antenna wires having respective ends joined to each other, and a plurality of parallel ground antenna wire mounted on the window glass panel in a position displaced inwardly from the hot antenna wire toward the geometric center of the window glass panel, the ground antenna wires having respective ends joined to each other and disposed near the joined ends of the hot antenna wires.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
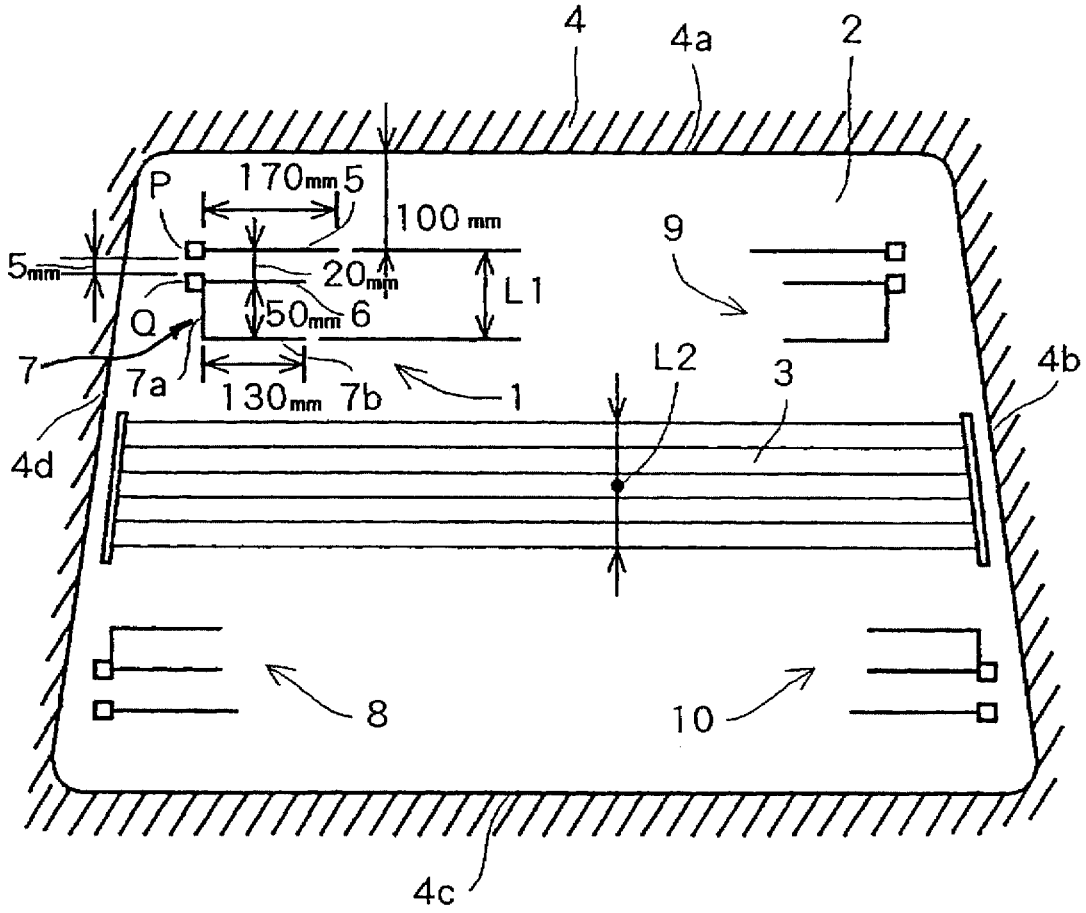
FIG. 1 is a schematic front elevational view of a window glass antenna for an automobile telephones according to a first embodiment of the present invention.

Like or corresponding parts are denoted by like or corresponding reference numerals throughout views.

As shown in FIG. 1, a window glass antenna 1 for automobile telephone according to a first embodiment of the present invention is disposed on an upper left area of a rear window glass panel 2 of an automobile. The rear window glass panel 2 supports a plurality of parallel horizontal defrosting hot wires 3 disposed on a vertically central area thereof. The rear window glass panel 2 is fixed in place by an upper horizontal member 4*a*, a right substantially vertical member 4*b*, a lower horizontal member 4*c*, and a left substantially vertical member 4*d* of a metallic window frame 4 of an automobile body.

The window glass antenna 1 has a hot antenna wire 5 extending horizontally and having a hot feeding point P on its left end, a ground antenna wire 6 extending horizontally parallel to the hot antenna wire 5 and spaced downwardly from the hot antenna wire 5, i.e., inwardly from the hot antenna wire 5 toward the geometric center of the rear window glass panel 2, and having a ground feeding point Q on its left end, and a ground antenna wire 7 composed of a vertical segment 7*a* extending vertically from the ground feeding point Q and a horizontal segment 7*b* extending horizontally to the right from the lower end of the vertical segment 7*a*.

Typically, the window glass antenna 1 has the following dimensions, for example: The hot antenna wire 5 has a length of 170 mm, the ground antenna wire 6 has a length of 130 mm, the vertical segment 7*a* has a length of 50 mm, and the horizontal segment 7*b* has a length of 130 mm. The hot antenna wire 5 is spaced from the upper horizontal member 4*a* of the metallic window frame 4 by a distance of 100 mm. The ground antenna wire 6 is spaced from the hot antenna wire 5 by a distance of 20 mm. The horizontal segment 7*b* is spaced from the ground antenna wire 6 by a distance of 50 mm. The hot feeding point P and the ground feeding point Q are spaced from each other by a distance of 5 mm.

The window glass antenna 1 has a good reception sensitivity if the distance between the hot antenna wire 5 and the upper horizontal member 4*a* is in the range of from 30 mm to 200 mm and the distance between the hot feeding point P and the ground feeding point Q is in the range of from 3 mm to 8 mm. The window glass antenna 1 also has a good reception sensitivity if the length of the hot antenna wire 5 ranges from 45 mm to 200 mm and the length of the ground antenna wire 6 (i.e., the horizontal segment 7*b*) is in the range of from 0.5 to 2 times the length of the hot antenna wire 5.

A feeding coaxial cable (not shown) has a core connected at one end to the hot feeding point P and a braided shield connected at one end to the ground feeding point Q. The other end of the feeding coaxial cable is connected to an antenna terminal of an automobile telephone set (not shown).

An electromagnetic wave induced in the upper horizontal member 4*a* of the metallic window frame 4 is picked up by the hot antenna wire 5 which is disposed closely to and extends parallel to the upper horizontal member 4*a*. Accordingly, the window glass antenna 1 has a sufficient reception sensitivity. Stated otherwise, an antenna wire for vertically polarized radio waves can be positioned horizontally on the rear window glass panel 2.

Since the window glass antenna 1 can have a reduced overall vertical length L1, therefore, the defrosting hot wires 3 has a vertical length L2 which may be increased by the reduction in the overall vertical length L1 of the window glass antenna 1. The defrosting hot wires 3 can provide an widened defrosting area on the rear window glass panel 2.

The hot antenna wire 5 can pick up electromagnetic waves induced in the upper horizontal member 4*a* of the metallic window frame 4 in a relatively wide frequency band. Consequently, the antenna wires or elements of the window glass antenna 1 may comprise thin copper wires or the like each having a diameter of 1 mm in the illustrated embodiment. The window glass antenna 1 composed of such thin antenna elements is relatively inconspicuous and does not interfere with the vision of the driver of the automobile. The window glass antenna 1 has a good reception sensitivity if each of the antenna elements has a diameter in the range of from 0.5 mm to 1.5 mm.

A window glass antenna 8, which is a vertical reversal of the window glass antenna 1, may be disposed on a lower left area of the rear window glass 2 near the lower horizontal member 4*c* of the metallic window frame 4. Similarly, a window glass antenna 9, which is a horizontal reversal of the window glass antenna 1, may be disposed on an upper right area of the rear window glass 2 near the upper horizontal member 4*a*, or a window glass antenna 10, which is a horizontal reversal of the window glass antenna 8, may be disposed on a lower right area of the rear window glass 2 near the lower horizontal member 4*c*.

Figure 2:
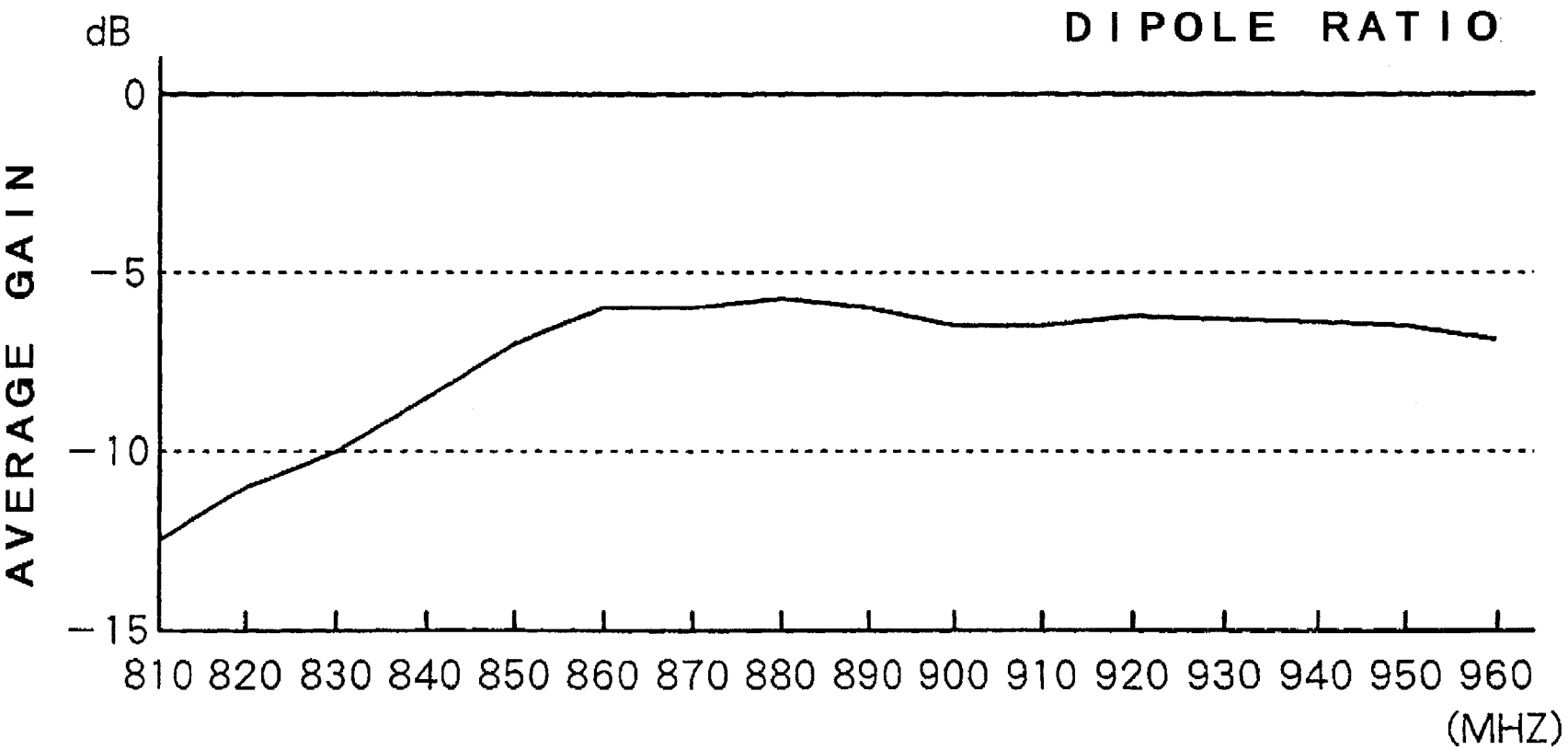
FIG. 2 is a diagram showing reception sensitivity characteristics of the window glass antenna shown in FIG. 1.

FIG. 2 shows reception sensitivity characteristics of the window glass antenna 1. To obtain the reception sensitivity characteristics shown in FIG. 2, the window glass antenna 1 was measured with the dimensions shown in FIG. 1 while it was positioned on the upper left area of the rear window glass panel 2. The average gain of a standard dipole antenna was assumed to be 0 dB.

The graph shown in FIG. 2 indicates that the average gain of the window glass antenna 1 increased from about −12.5 dB to −6 dB in a frequency range from 810 MHz to 860 MHz, whereas the average gain remained at about −6 dB in a frequency range from 860 MHz to 960 MHz. The illustrated data of reception sensitivity characteristics of the window glass antenna 1 are substantially equal to those of a window glass antenna whose hot antenna element is disposed vertically.

Figure 3:
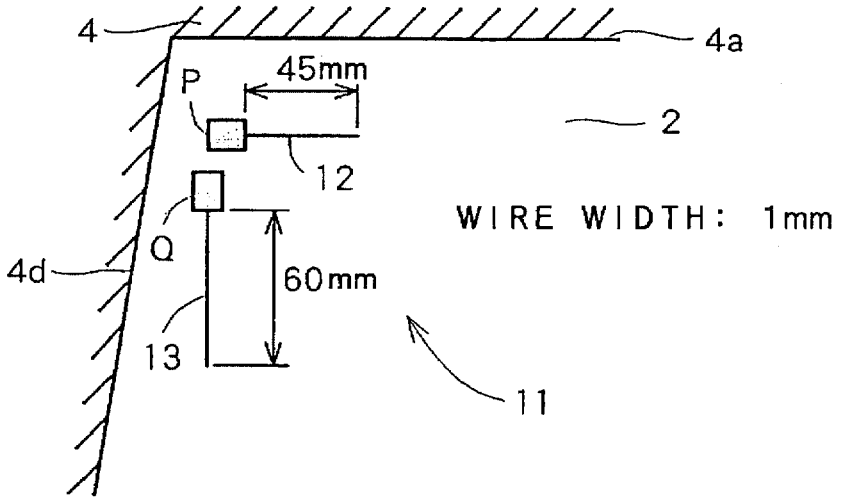
FIG. 3 is a schematic front elevational view of a window glass antenna for an automobile telephone according to a second embodiment of the present invention.

FIG. 3 shows a window glass antenna 11 for an automobile telephone according to a second embodiment of the present invention. The window glass antenna 11 is positioned on an upper left area of a rear window glass panel 2. The window glass antenna 11 comprises a hot antenna wire 12 extending horizontally and having a hot feeding point P on its left end, the hot antenna wire 12 being 45 mm long, and a ground antenna wire 13 disposed adjacent to and below the hot feeding point P and extending vertically, the ground antenna wire 13 being 60 mm long and having a ground feeding point Q on its upper end.

As with the window glass antenna 1 shown in FIG. 1, the hot antenna wire 12 of the window glass antenna 11 picks up an electromagnetic wave induced in an upper horizontal member 4*a* of a metallic window frame 4. The window glass antenna 11 is less conspicuous than the window glass antenna 1 because the hot and ground antenna wires 12, 13 extend respectively along the horizontal and vertical members 4*a*, 4*d* of the metallic window frame 4.

The window glass antenna 11 may be located on an upper right area, a lower left area, or a lower right area of the rear window glass panel 2.

Figure 4:
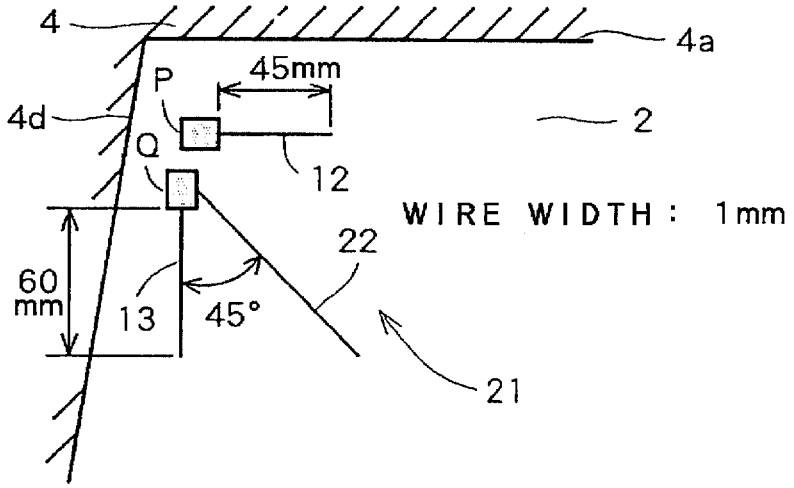
FIG. 4 is a schematic front elevational view of a window glass antenna for an automobile telephone according to a third embodiment of the present invention.

FIG. 4 shows a window glass antenna 21 for an automobile telephone according to a third embodiment of the present invention. The window glass antenna 21 is similar to the window glass antenna 11 shown in FIG. 3 except that a ground antenna wire 22 is additionally connected at its upper end to the ground feeding point Q. The ground antenna wire 22 is angularly spaced 45° counterclockwise from the ground antenna wire 13 about the ground feeding point Q.

Figure 5:
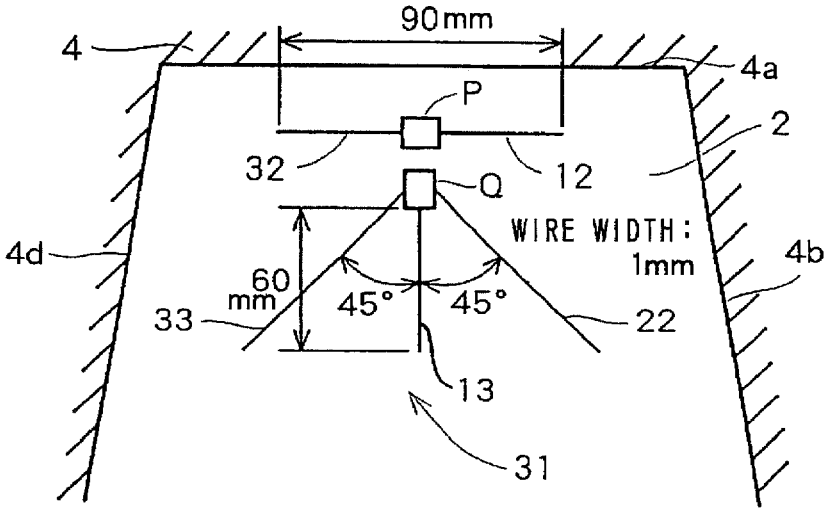
FIG. 5 is a schematic front elevational view of a window glass antenna for automobile telephone according to a fourth embodiment of the present invention.

FIG. 5 illustrates a window glass antenna 31 for automobile telephone according to a fourth embodiment of the present invention. The window glass antenna 31 is located on an upper central area of a rear window glass panel 2. The window glass antenna 31 comprises a hot antenna wire 12 extending horizontally and having a hot feeding point P on its left end, a ground antenna wire 13 disposed adjacent to and below the hot feeding point P and extending vertically, the ground antenna wire 13 being 60 mm long and having a ground feeding point Q on its upper end, and a ground antenna wire 22 connected at its upper end to the ground feeding point Q and angularly spaced 45° counterclockwise from the ground antenna wire 13 about the ground feeding point Q. The above structure of the window glass antenna 31 is the same as that of the window glass antenna 21 shown in FIG. 4. The window glass antenna 31 also comprises a hot antenna wire 32 extending horizontally to the right from the hot feeding point P, and a ground antenna wire 33 connected at its upper end to the ground feeding point Q and angularly spaced 45° clockwise from the ground antenna wire 13 about the ground feeding point Q.

Figure 6:
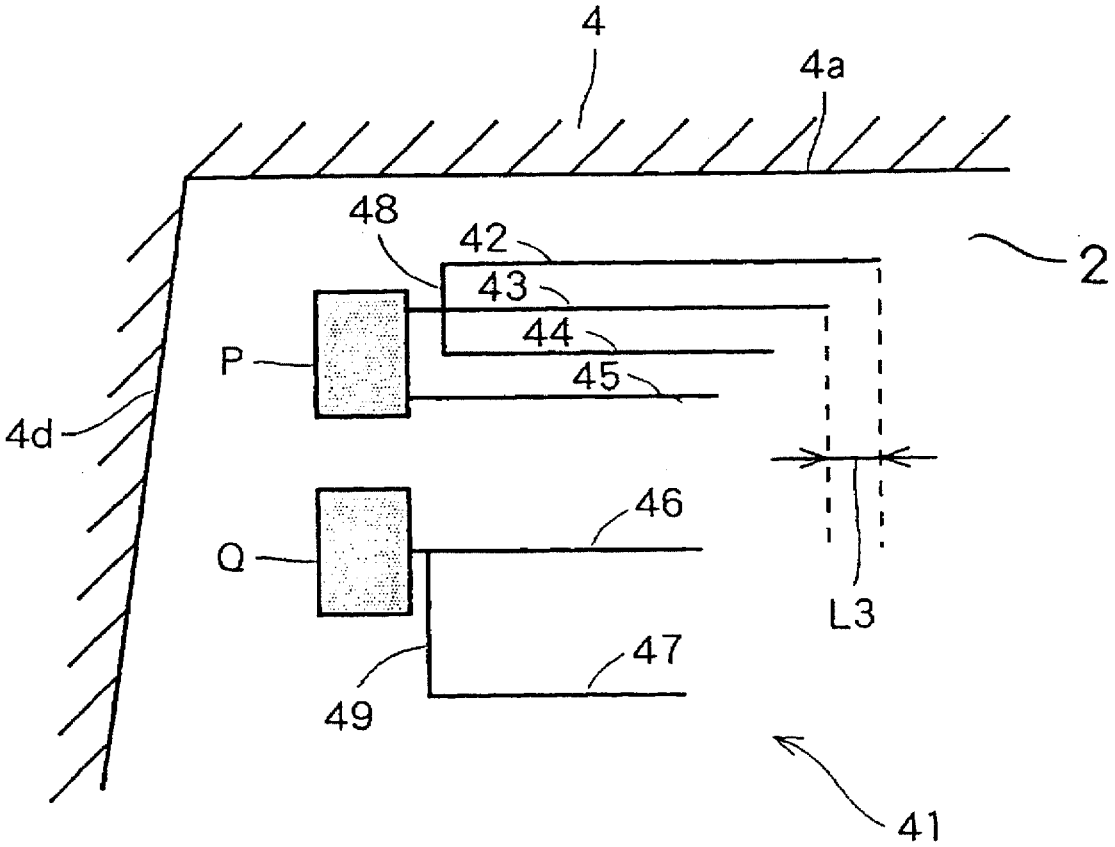
FIG. 6 schematic front elevational view of a window glass antenna for automobile telephone according to a fifth embodiment of the present invention.
Figure 7:
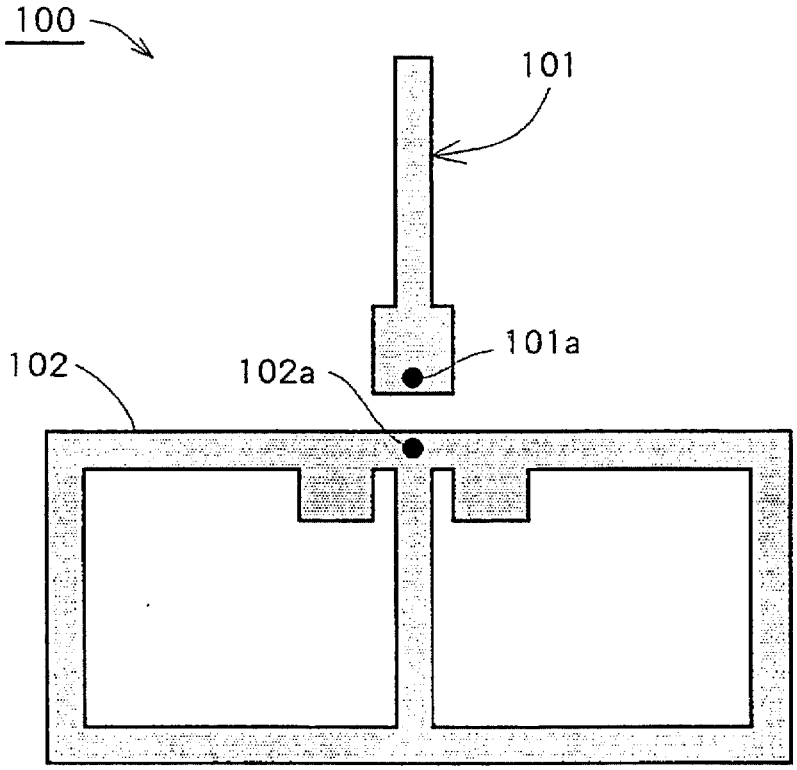
FIG. 7 (PRIOR ART)
FIG. 7 is a schematic front elevational view of a conventional win glass antenna for automobile telephone.
Figure 8:
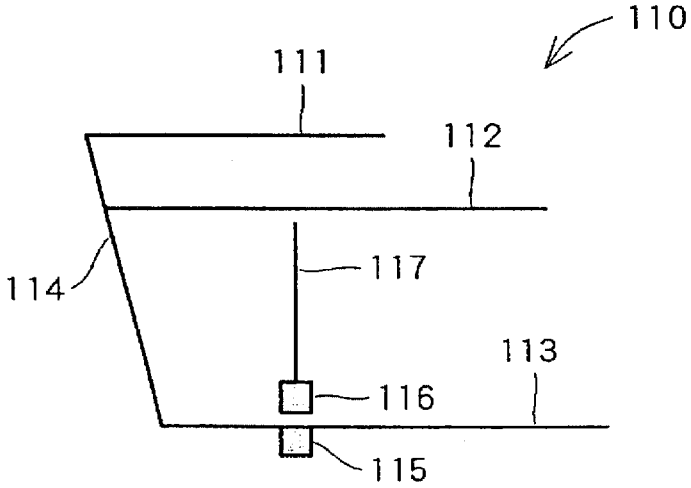
FIG. 8 (PRIOR ART)
FIG. 8 is a schematic front elevational view of another conventional window glass antenna for automobile telephone.

FIG. 6 shows a window glass antenna 41 for automobile telephone according to a fifth embodiment of the present invention. The window glass antenna 41, which is positioned on an upper right area of a rear window glass panel 2, has a plurality of horizontal hot antenna wires and a plurality of horizontal ground antenna wires. Specifically, the window glass antenna 41 comprises four parallel hot antenna wires 42, 43, 44, 45 extending horizontally to the right from a hot feeding point P, and two parallel ground antenna wires 46, 47 extending horizontally to the right from a ground feeding point Q which is vertically spaced downwardly from the hot feeding point P. The hot antenna wires 42, 43, 44 are interconnected at their left ends by a vertical joint wire 48. The ground antenna wires 46, 47 are interconnected at their left ends by a vertical joint wire 49.

The window glass antenna 41 is advantageous in that the frequency bandwidth of the window glass antenna 41 may be varied by varying the difference L3 between the lengths of the hot antenna wires 42, 43, for example, and the vertical dimension of the window glass antenna 41 may be reduced as the hot and ground antenna wires extend horizontally.

In each of the illustrated embodiments, the antenna wires are mounted on a face side of the window glass panel. However, the antenna wires may be mounted on a back side of the window glass panel, or may be sandwiched between two window glass layers of a window glass panel.

With the arrangement of the-present invention, the window glass antenna has a sufficient reception sensitivity as the hot antenna wire or wires are electromagnetically coupled to the metallic window frame member. Accordingly, the hot antenna wire of an antenna for receiving vertically polarized radio waves may be disposed close to the metallic window frame and extend horizontally. Since the antenna can be positioned closely to the upper or lower end of the window glass panel, it does not interfere with the driver's vision through the window glass panel, allowing a wide central area of the window glass panel to be available for the installation of defrosting wires, for example.

In the case where the antenna wire for receiving vertically polarized radio waves is disposed in a space above or below the defrosting wires on the window glass panel, since the antenna takes up a relatively small area, the vertical dimension of the defrosting wires may be large enough to provide a sufficiently wide defrosting range on the window glass panel.

Inasmuch as the frequency band of the window glass antenna according to the present invention can be relatively wide, it is not necessary for the antenna to have antenna elements in a wide pattern. Therefore, the antenna elements may be composed of thin wires which are effective to give the driver improved visibility through the antenna on the window glass panel.

The ground antenna wire of the window glass antenna according to the present invention can be oriented in any direction from one end thereof. For example, the ground antenna wire may be disposed parallel to the hot antenna wire, thus reducing the vertical dimension of the window glass antenna.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A window glass antenna for an automobile telephone, comprising:

a window glass panel being enclosed by a metallic window frame having upper and lower horizontal members, said metallic window frame for being received in an automobile body;

a plurality of defroster wires mounted on said window glass panel;

a hot antenna portion and a ground antenna portion mounted on said window glass panel, said ground antenna portion including at least one ground antenna wire between said defroster wires and said hot antenna portion, said hot antenna portion being located nearer one of said upper and lower horizontal members of said metallic window frame, said hot antenna portion being located between said one of said upper and lower horizontal members and said ground portion, said hot antenna portion including means for electromagnetically coupling with said one of said upper and lower horizontal members, said coupling means including at least one hot antenna wire mounted substantially horizontally on said window frame.

2. The window glass antenna according to claim 1, wherein said at least one ground antenna wire is mounted on said window glass panel substantially horizontally.

3. The window glass antenna according to claim 2, further comprising a second ground antenna wire including a vertical segment connected to said end of said at least one ground antenna wire and a horizontal segment connected to said vertical segment.

4. A window glass antenna according to claim 1, wherein said at least one ground antenna wire extends substantially vertically.

5. A window glass antenna according to claim 4, further comprising a second ground antenna wire connected to said end of said at least one ground antenna wire, wherein said second ground antenna wire is 45° from said at least one ground antenna wire.

6. A window glass antenna according to claim 5, further comprising a third ground antenna wire connected to said end of said at least one ground antenna wire, wherein said third ground antenna wire is angularly spaced 45° from said at least one ground antenna wire.

7. A window glass antenna for an automobile telephone, comprising:

a window glass panel being enclosed by a metallic window frame having upper and lower horizontal members, said metallic window frame for being received in an automobile body;

a plurality of defroster wires mounted on said window glass panels;

a hot antenna portion and a ground antenna portion mounted on said window glass panel, said ground antenna portion including a plurality of ground antenna wires between said defroster wires and said hot antenna portion, said hot antenna portion being located nearer one of said upper and lower horizontal members of said metallic window frame, said hot antenna portion being located between said one of said upper and lower horizontal members and said ground portion, said hot antenna portion including means for electromagnetically coupling with said one of said upper and lower horizontal members, said coupling means including a plurality of hot antenna wires mounted on said window glass panels substantially horizontally, said hot antenna wires including first ends joined to each other, said ground antenna wires including second ends joined to each other and disposed near the joined first ends of said plurality of said hot antenna wires.

8. The window glass antenna according to claim 1, wherein said at least one ground antenna wire is mounted substantially parallel to said hot antenna wire.

9. The window glass antenna of claim 1, wherein said means for electromagnetically coupling said at least one hot antenna wire with at least one of said upper or lower horizontal metallic window frame members includes a conductor free region of said window glass panel intermediate said at least one hot antenna wire and said at least one of said upper or lower horizontal metallic window frame members.

10. The window glass antenna of claim 7, wherein said means for electromagnetically coupling said plurality of said hot antenna wires with at least one of said upper or lower horizontal metallic window frame members includes a conductor free region of said window glass panel intermediate said plurality of said hot antenna wires and said at least one of said upper or lower horizontal metallic window frame members.

* * * * *